US008538580B2

(12) United States Patent
Brownlee

(10) Patent No.: US 8,538,580 B2
(45) Date of Patent: Sep. 17, 2013

(54) SHEET PRODUCT DISPENSERS AND METHODS FOR CONTROLLING THE DISPENSERS

(75) Inventor: Warren R. Brownlee, Palmetto, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 626 days.

(21) Appl. No.: 12/173,266

(22) Filed: Jul. 15, 2008

(65) Prior Publication Data

US 2010/0012674 A1 Jan. 21, 2010

(51) Int. Cl.
*G07F 17/00* (2006.01)
*A47K 10/34* (2006.01)

(52) U.S. Cl.
USPC ..... 700/232; 221/199; 221/42; 221/9

(58) Field of Classification Search
USPC .. 221/42, 2, 4, 9, 13, 199, 277; 700/231–232
See application file for complete search history.

(56) References Cited

U.S. PATENT DOCUMENTS

| | | | | |
|---|---|---|---|---|
| 2,814,081 | A | 11/1957 | Stevenson | |
| 2,887,204 | A | 5/1959 | Giuliano | |
| 4,087,925 | A | 5/1978 | Bienek | |
| 4,104,814 | A | 8/1978 | Whight | |
| 4,620,502 | A * | 11/1986 | Kimble | 118/419 |
| 4,670,010 | A | 6/1987 | Dragone | |
| 5,135,721 | A | 8/1992 | Richard | |
| 5,216,251 | A | 6/1993 | Matschke | |
| 5,459,944 | A | 10/1995 | Tatsutani et al. | |
| 5,498,394 | A | 3/1996 | Matschke | |
| 6,254,625 | B1 * | 7/2001 | Rosenthal et al. | 607/88 |
| 7,774,096 | B2 * | 8/2010 | Goerg et al. | 700/236 |
| 7,931,859 | B2 * | 4/2011 | Mlodzinski et al. | 422/24 |
| 2005/0076529 | A1 | 4/2005 | Holmes | |
| 2005/0139239 | A1 | 6/2005 | Prae | |
| 2006/0173576 | A1 * | 8/2006 | Goerg et al. | 700/236 |
| 2006/0213924 | A1 | 9/2006 | Ophardt | |
| 2007/0256226 | A1 | 11/2007 | Pinizzotto | |
| 2009/0084811 | A1 * | 4/2009 | Nelson et al. | 221/71 |
| 2009/0265990 | A1 * | 10/2009 | Stratmann | 49/31 |
| 2010/0012679 | A1 | 1/2010 | Brownlee | |

FOREIGN PATENT DOCUMENTS

| | | | |
|---|---|---|---|
| JP | 11-128115 | A | 5/1999 |
| WO | 2005074776 | A1 | 8/2005 |

OTHER PUBLICATIONS

Ultraviolet, Wikipedia, Nov. 26, 2007, http://www.en.wikipedia.org/wiki/UV_light.

Ultraviolet Germicidal Irradiation, Nov. 26, 2007, http://www.en.wikipedia.org/wiki/Ultraviolet_germicidal-irradiation.

Pennstate Department of Architectural Engineering, Ultraviolet Germicidal Irradiation, Nov. 26, 2011, http://www.engr.psu.edu/ae/iec/abe/control/ultraviolet.asp.

(Continued)

*Primary Examiner* — Michael K Collins
(74) *Attorney, Agent, or Firm* — Deborah K. Butler

(57) ABSTRACT

Sheet product dispensers and methods for controlling the dispensers are provided. A sheet product dispenser includes a housing and a dispensing assembly disposed in the housing. The dispensing assembly is configured to hold a roll of sheet product thereon and to dispense a portion of the roll of sheet product. The sheet product dispenser further includes an ultraviolet light source disposed on the housing. The ultraviolet light source is configured to emit ultraviolet light.

12 Claims, 11 Drawing Sheets

(56) References Cited

OTHER PUBLICATIONS

Non-Final Office Action for U.S. Appl. No. 12/173,287 mailed Mar. 29, 2011.

Final Office Action for U.S. Appl. No. 12/173,287 mailed Sep. 22, 2011.

Office Action for U.S. Appl. No. 12/173,287 mailed Apr. 20, 2012.

* cited by examiner

SHEET PRODUCT DISPENSERS AND METHODS FOR CONTROLLING THE DISPENSERS

BACKGROUND OF THE INVENTION

Sheet product dispensers have been developed that dispense a sheet product. After a sheet product dispenser dispenses a sheet product, the person typically wipes off their hands with the sheet product. After the person wipes off their hands, some bacteria may undesirably remain on the hands.

Accordingly, the inventor herein has recognized a need for a sheet product dispenser that minimizes and/or eliminates bacteria on the hands.

BRIEF DESCRIPTION OF THE INVENTION

A sheet product dispenser in accordance with an exemplary embodiment is provided. The sheet product dispenser includes a housing and a dispensing assembly disposed in the housing. The dispensing assembly is configured to hold a roll of sheet product thereon and to dispense a portion of the roll of sheet product. The sheet product dispenser further includes an ultraviolet light source disposed on the housing. The ultraviolet light source is configured to emit ultraviolet light.

A method for controlling a sheet product dispenser in accordance with another exemplary embodiment is provided. The sheet product dispenser has a sensor, a dispensing assembly, an ultraviolet light source, and a controller. The method includes generating a first signal utilizing the sensor of the sheet product dispenser. The method further includes generating a second signal to induce the ultraviolet light source to emit ultraviolet light in response to the controller of the sheet product dispenser receiving the first signal from the sensor.

DETAILED DESCRIPTION OF THE INVENTION

Figure 1:
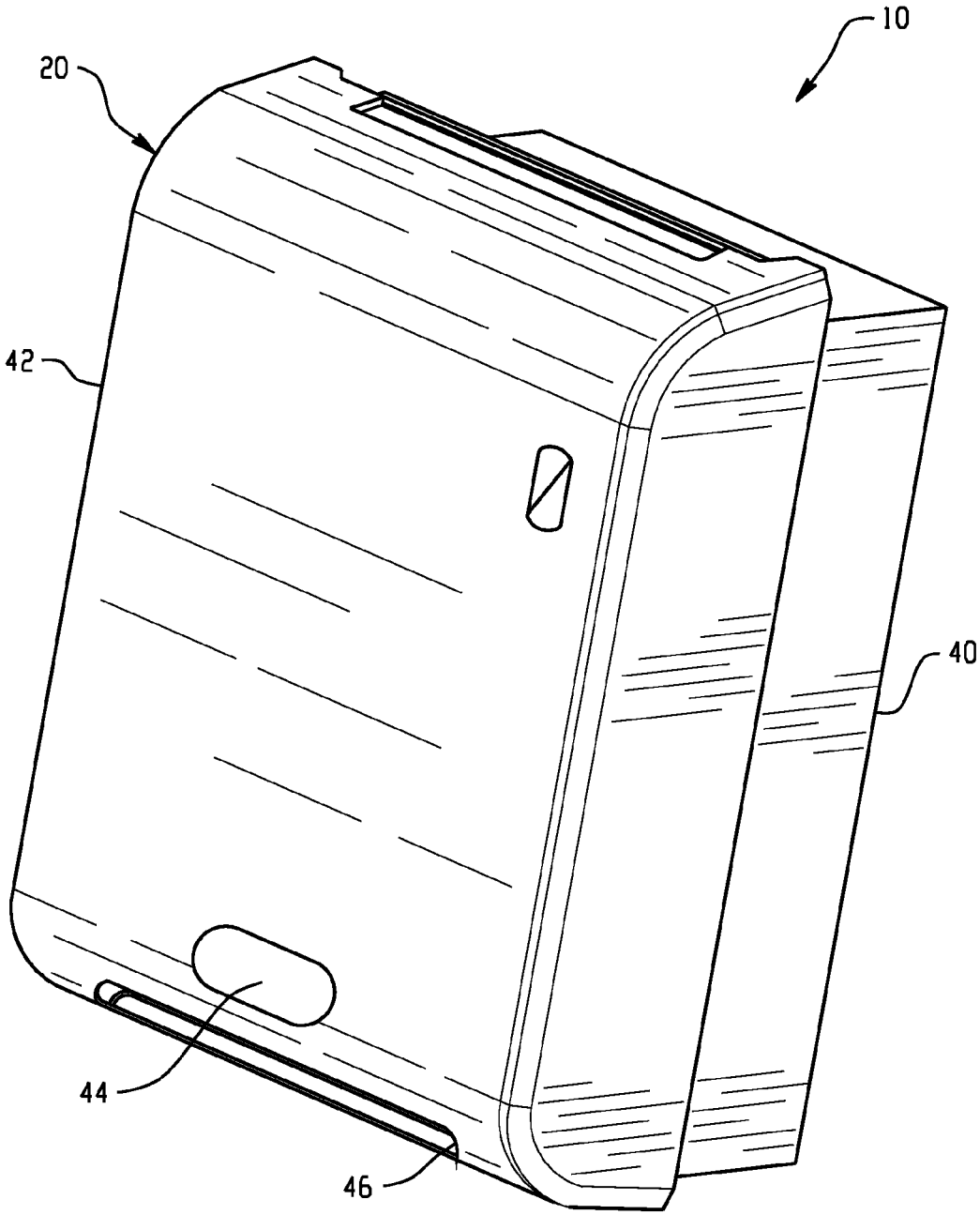
FIG. 1 is a schematic of an automatic sheet product dispenser in accordance with an exemplary embodiment.

Referring to FIGS. 1 through 4, an automatic sheet product dispenser 10 for dispensing a roll of sheet product 12 is illustrated. The automatic sheet product dispenser 10 includes a housing 20, a motor 21, a dispensing assembly 22, a proximity sensor 24, an ultraviolet light source 26, and a controller 30 (FIG. 6).

The housing 20 is provided to enclose a portion of the remaining components of the automatic sheet product dispenser 10. The housing 20 includes a back housing portion 40 and a front cover 42. In one exemplary embodiment, the back housing portion 40 and the front cover 42 are constructed from plastic. The front cover 42 is configured to be rotatably attached to the back housing portion 40. The back housing portion 40 is configured to be mounted on a wall (not shown). The front cover 42 includes a window 44 therein for allowing the proximity sensor 24 to detect an object proximate to the front cover 42. The front cover 42 further includes a discharge opening 46 for allowing a portion of the roll of sheet product 12 to extend therethrough.

Figure 4:
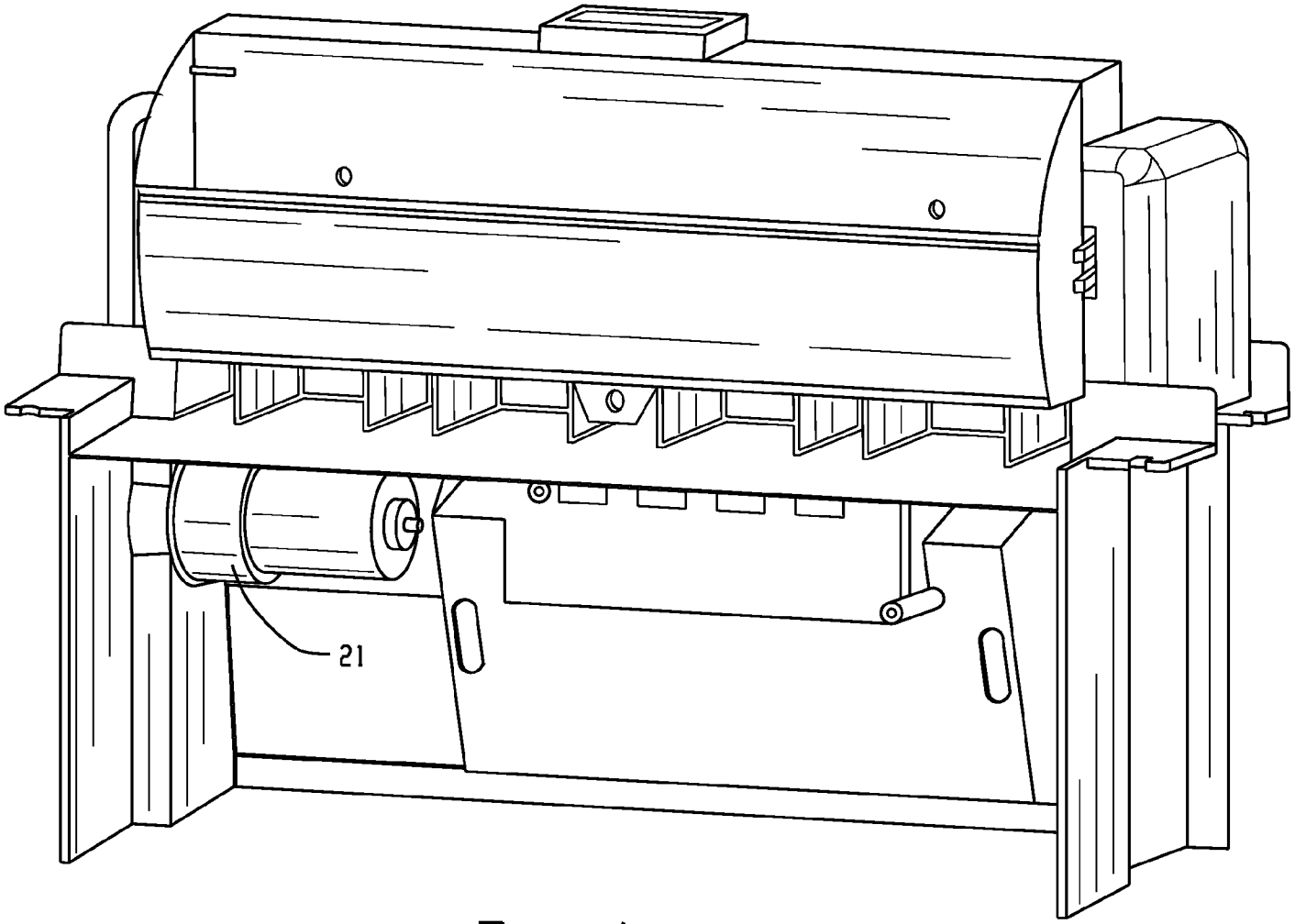
FIG. 4 is a schematic of a portion of the automatic sheet product dispenser of FIG. 1.
Figure 6:
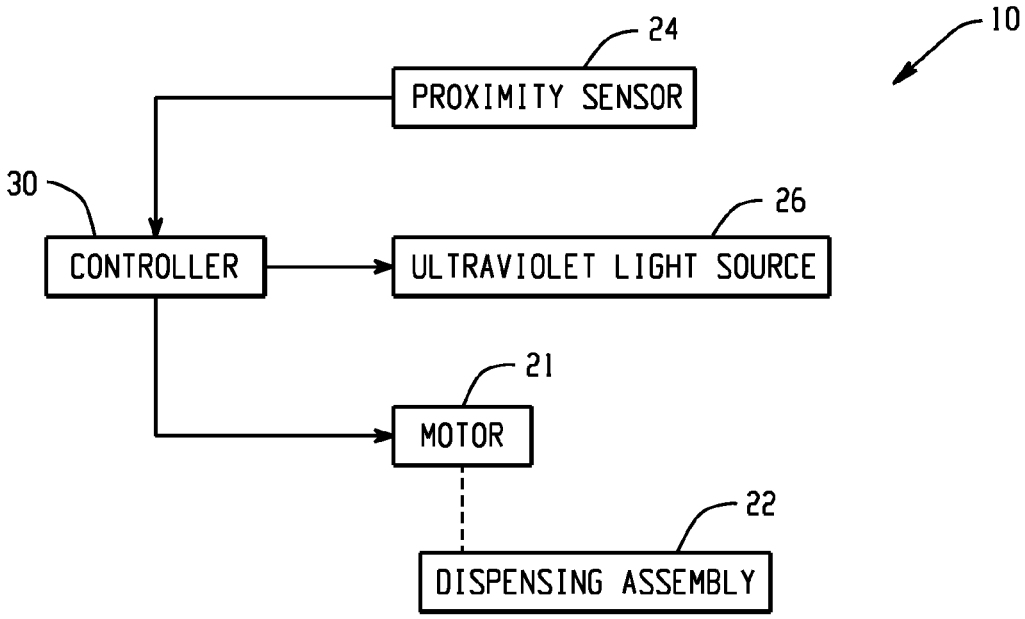
FIG. 6 is a schematic of a control system utilized in the automatic sheet product dispenser of FIG. 1.

Referring to FIGS. 4 and 6 (with periodic reference to FIGS. 1 and 2), the motor 21 is provided to drive the dispensing assembly 22 for dispensing a portion of the roll of sheet product 12 from the automatic sheet product dispenser 10. In particular, the motor 21 drives the dispensing assembly 22 in response to receiving control signals from the controller 30.

Figure 2:
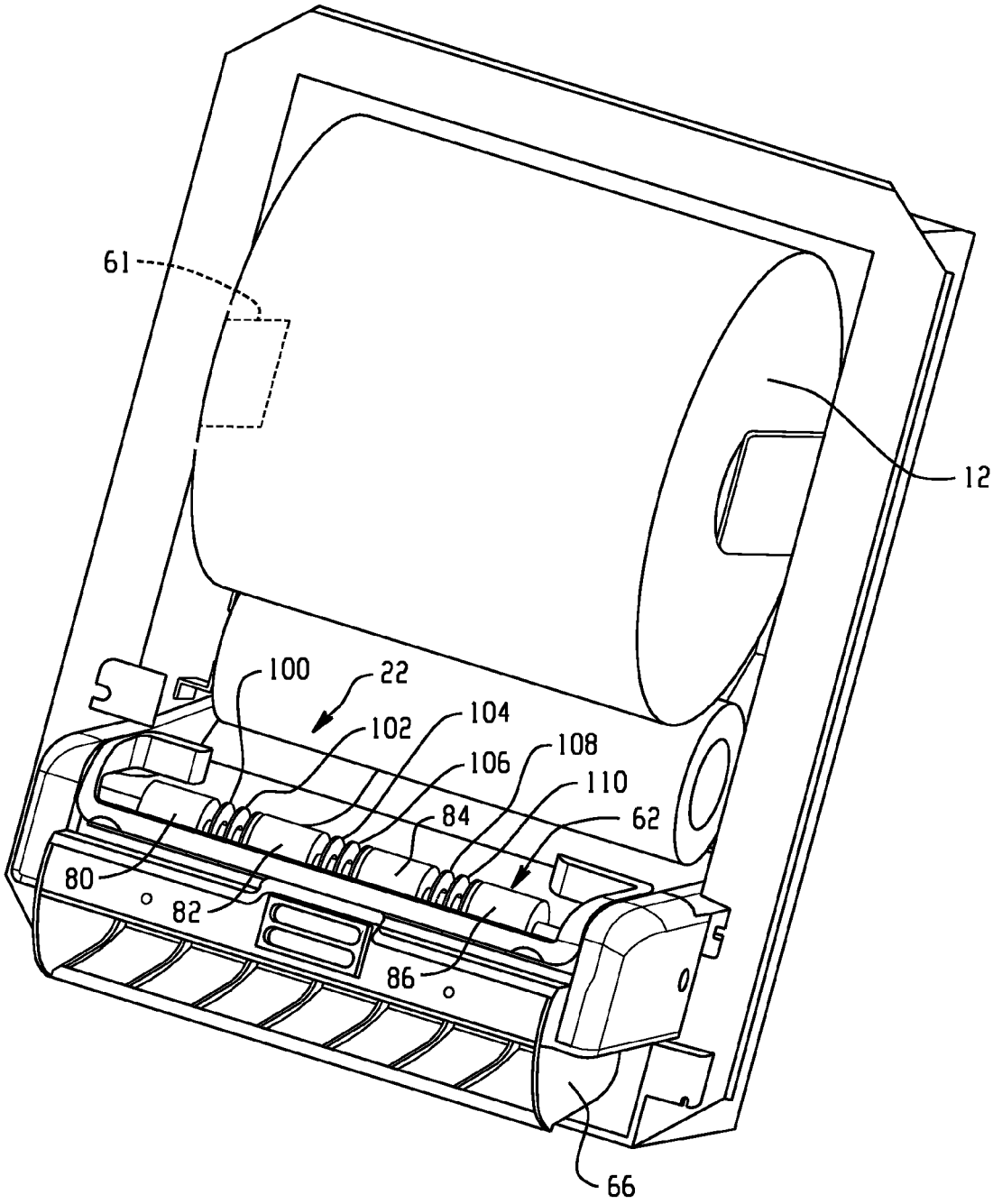
FIG. 2 is a schematic of a portion of the automatic sheet product dispenser of FIG. 1.
Figure 3:
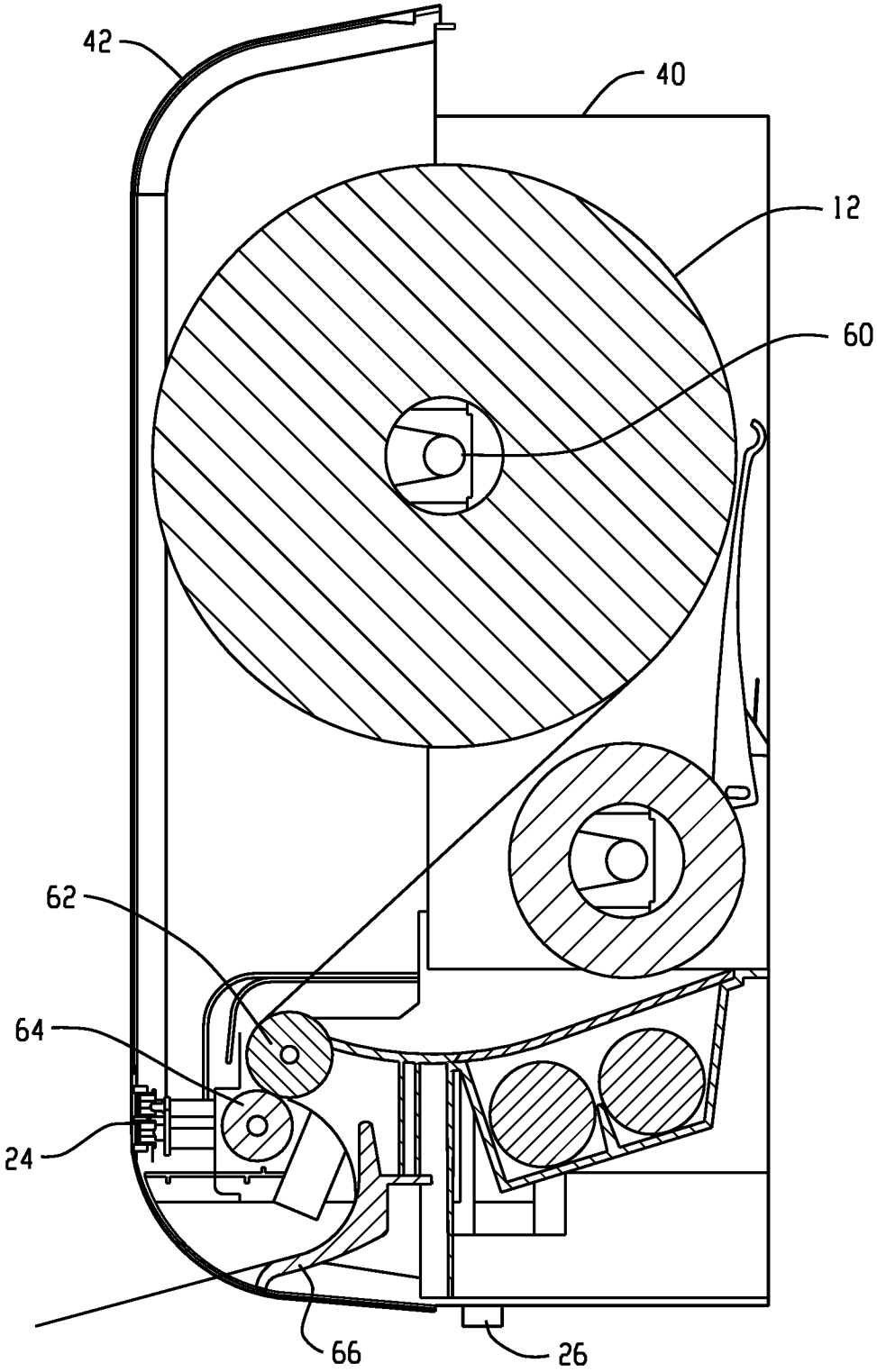
FIG. 3 is a cross-sectional schematic of the automatic sheet product dispenser of FIG. 1.
Figure 5:
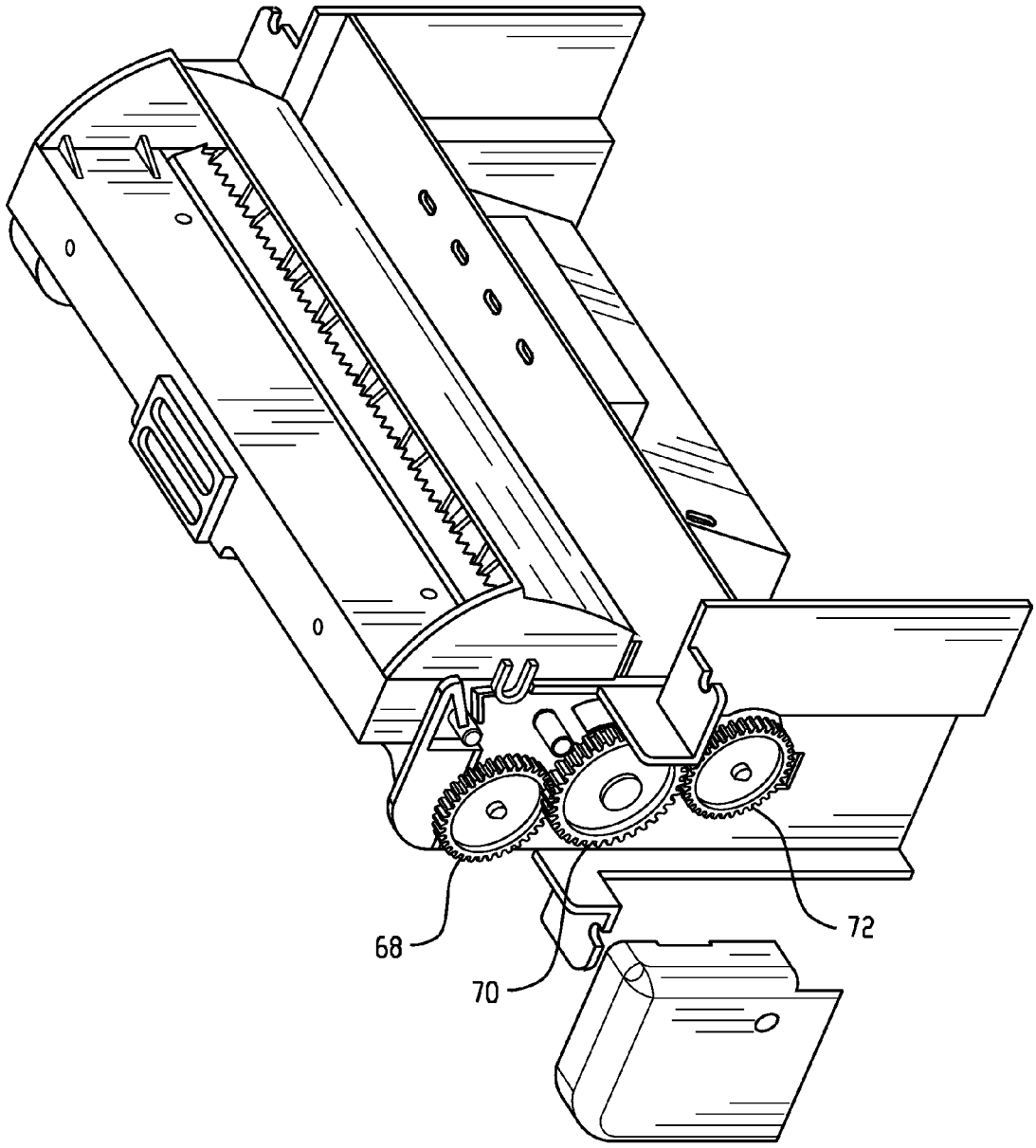
FIG. 5 is a schematic of a portion of the automatic sheet product dispenser of FIG. 1.

Referring to FIGS. 2, 3 and 5, the dispensing assembly 22 is provided to dispense a portion of the roll of sheet product 12. The dispensing assembly 22 includes hubs 60, 61, a feed roller 62, a pinch roller 64, a dispensing shelf 66, and drive gears 68, 70, 72.

The hubs 60, 61 are attached to the back housing portion 40 and are configured to hold the roll of sheet product 12 therebetween. When dispensing a portion of the roll of sheet product 12, the roll of sheet product 12 rotates relative to the hubs 60, 61.

The feed roller 62 is configured to feed a portion of the roll of sheet product 12 onto the dispensing shelf 66. The feed roller 62 has a width equal to a width of the roll of sheet product 12. The feed roller 62 includes roller portions 80, 82, 84, 86 with intermediate bosses 100, 102, 104, 106, 108, 110. During operation, the feed roller 62 is driven by the motor 21 (FIG. 4), via the drive gears 68, 70, 72. When the feed roller 62 rotates, the feed roller 62 urges a portion of the roll of sheet product 12 disposed between the feed roller 62 and the pinch roller 64 to move toward the dispensing shelf 66. The dispensing shelf 66 deflects the portion of the sheet product 12 outwardly from the front cover 42.

Referring to FIGS. 3 and 6, the proximity sensor 24 is configured to generate a signal when an object is disposed proximate to the proximity sensor 24. In particular, the proximity sensor 24 generates the signal when a person's hands are disposed proximate to the housing 20 to receive a portion of the roll of sheet product 12. The signal from the proximity sensor 24 is received by the controller 30. In one exemplary embodiment, the proximity sensor 24 is disposed proximate to the window 44 (FIG. 1) of the front cover 42.

The ultraviolet light source 26 is configured to emit ultraviolet light in response to signal received from the controller 30. In one exemplary embodiment, the ultraviolet light source 26 is disposed on an external portion of the housing 20 (FIG. 1). Further, in one exemplary embodiment, the ultraviolet light is in either the B-band (i.e., 320 nm-280 nm wavelength with energy per photon of 3.10-3.87 eV) or C-band (i.e., below 280 nm wavelength with energy per photon of 4.43-6.20 eV) of an ultraviolet light spectrum. In another exemplary embodiment, the ultraviolet light has a wavelength of 253.7 nm with a radiation level of 3.0 Joules/$m^2$.

Referring to FIG. 6 (with periodic reference to FIGS. 1 through 4), the controller 30 is provided to control operation of the automatic sheet product dispenser 10. The controller 30 is electrically coupled to the proximity sensor 24, the ultraviolet light source 26, and the motor 21. The controller 30 is configured to receive a signal from the proximity sensor 24 indicating an object, such as a person's hands, are disposed proximate to the housing 20. The controller 30 is further configured to generate another signal to induce the ultraviolet light source 26 to emit ultraviolet light onto a person's hands to kill bacteria thereon. The controller 30 is further configured to generate another signal to actuate the motor 21 to drive the dispensing assembly 22 to urge a portion of the roll of sheet product 12 from the automatic sheet product dispenser 10.

Figure 7:
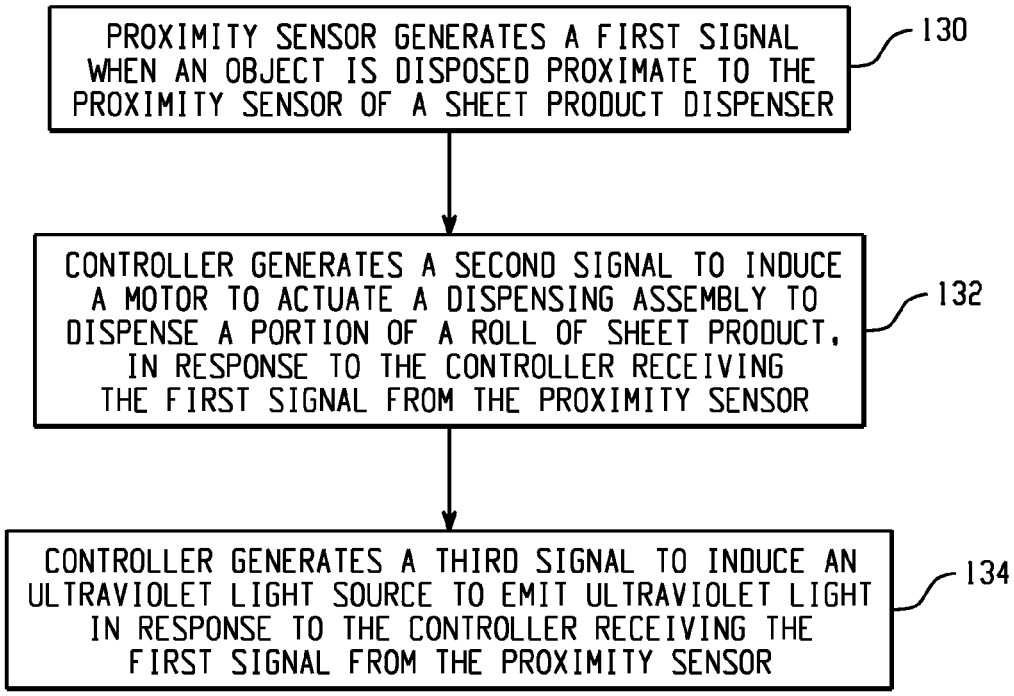
FIG. 7 is a flowchart of a method for controlling the automatic sheet product dispenser of FIG. 1 in accordance with another exemplary embodiment.

Referring to FIG. 7 (with periodic reference to FIGS. 1 through 4 and 6), a flowchart of a method for controlling of the automatic sheet product dispenser 10 in accordance with another exemplary embodiment will now be explained.

At block 130, the proximity sensor 24 generates a first signal when an object is disposed proximate to the proximity sensor 24 of the automatic sheet product dispenser 10.

At block 132, the controller 30 generates a second signal to induce the motor 21 to actuate the dispensing assembly 22 to dispense a portion of the roll of sheet product 12, in response to the controller 30 receiving the first signal from the proximity sensor 24.

At block 134, the controller 30 generates a third signal to induce the ultraviolet light source 26 to emit ultraviolet light in response to the controller 30 receiving the first signal from the proximity sensor 24.

Figure 8:
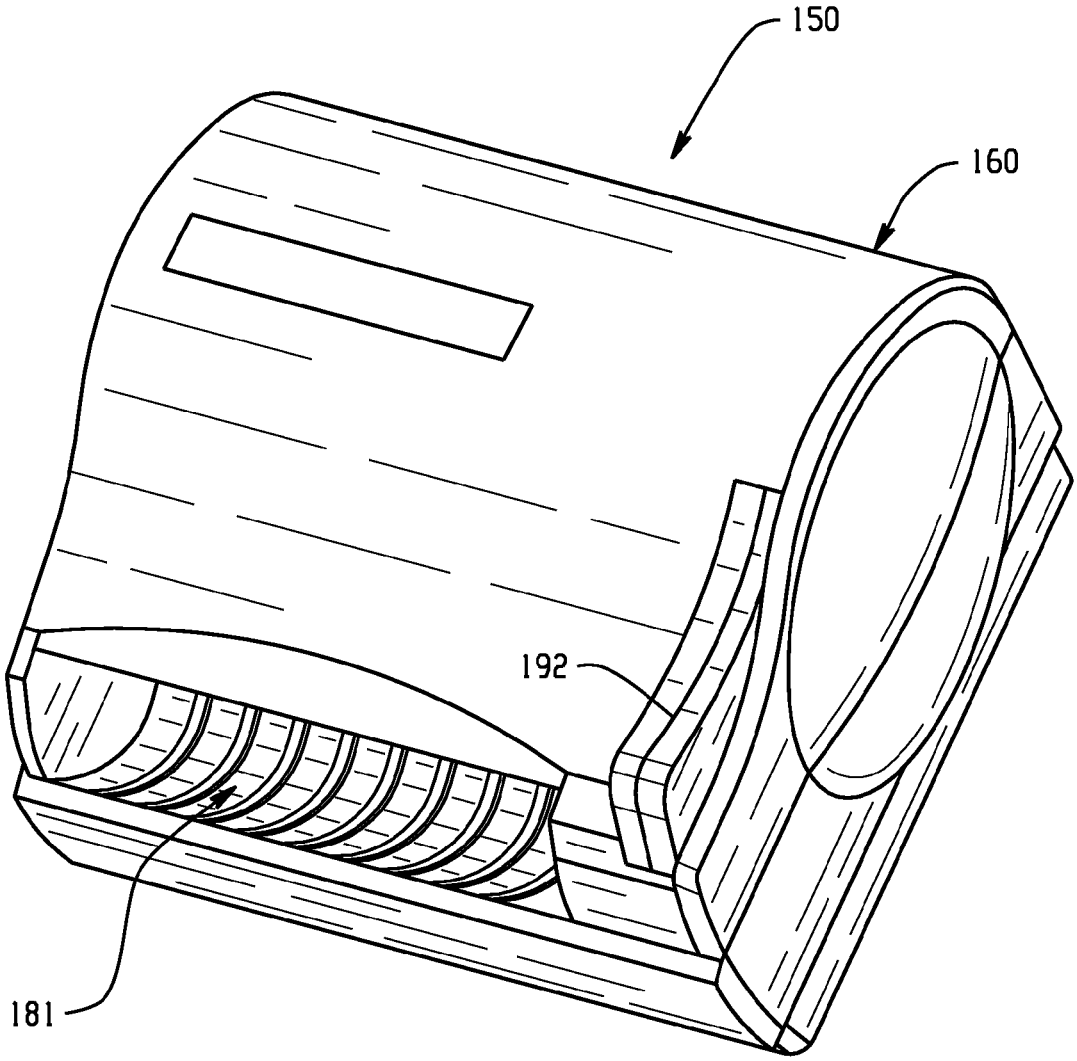
FIG. 8 is a schematic of a manual sheet product dispenser in accordance with another exemplary embodiment.
Figure 9:
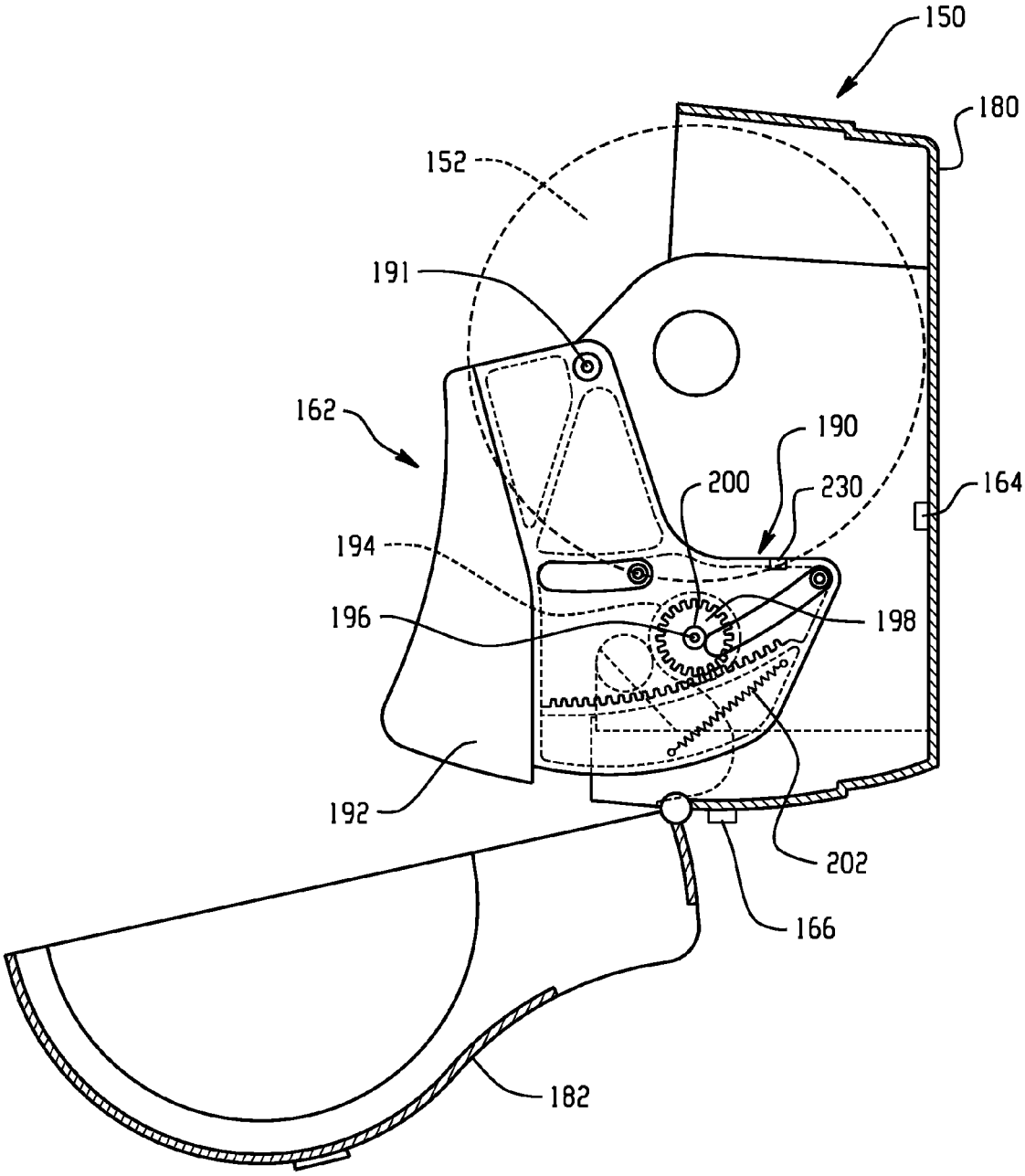
FIG. 9 is a schematic of a portion of the manual sheet product dispenser of FIG. 8.
Figure 12:
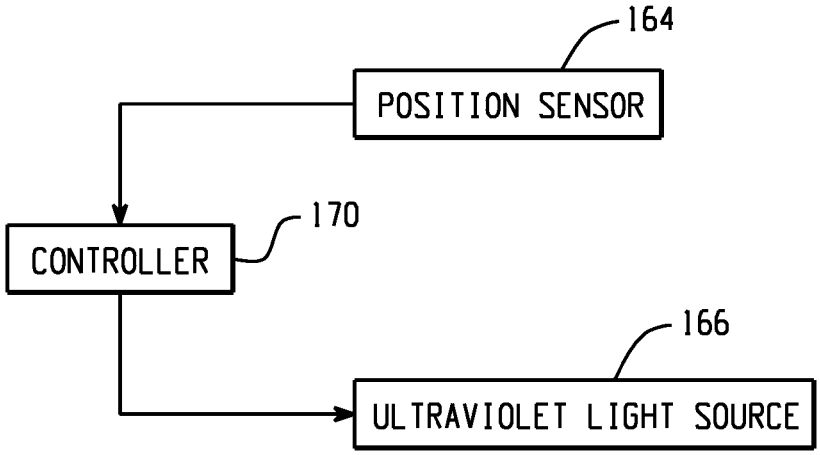
FIG. 12 is a schematic of a control system utilized in the manual sheet product dispenser of FIG. 8.

Referring to FIGS. 8 and 9, a manual sheet product dispenser 150 for dispensing a roll of sheet product 152 in accordance with another exemplary embodiment is illustrated. The manual sheet product dispenser 150 includes a housing 160, a dispensing assembly 162, a position sensor 164, an ultraviolet light source 166, and a controller 170 (FIG. 12).

The housing 160 is provided to enclose a portion of the remaining components of the manual sheet product dispenser 150. The housing 160 includes a back housing portion 180 and a front cover 182. In one exemplary embodiment, the back housing portion 180 and the front cover 182 are constructed from plastic. The front cover 182 is configured to be rotatably attached to the back housing portion 180. The back housing portion 180 is configured to be mounted on a wall (not shown). The back housing portion 180 includes a discharge chute 181 for discharging a portion of the roll of sheet product 152.

Figure 11:
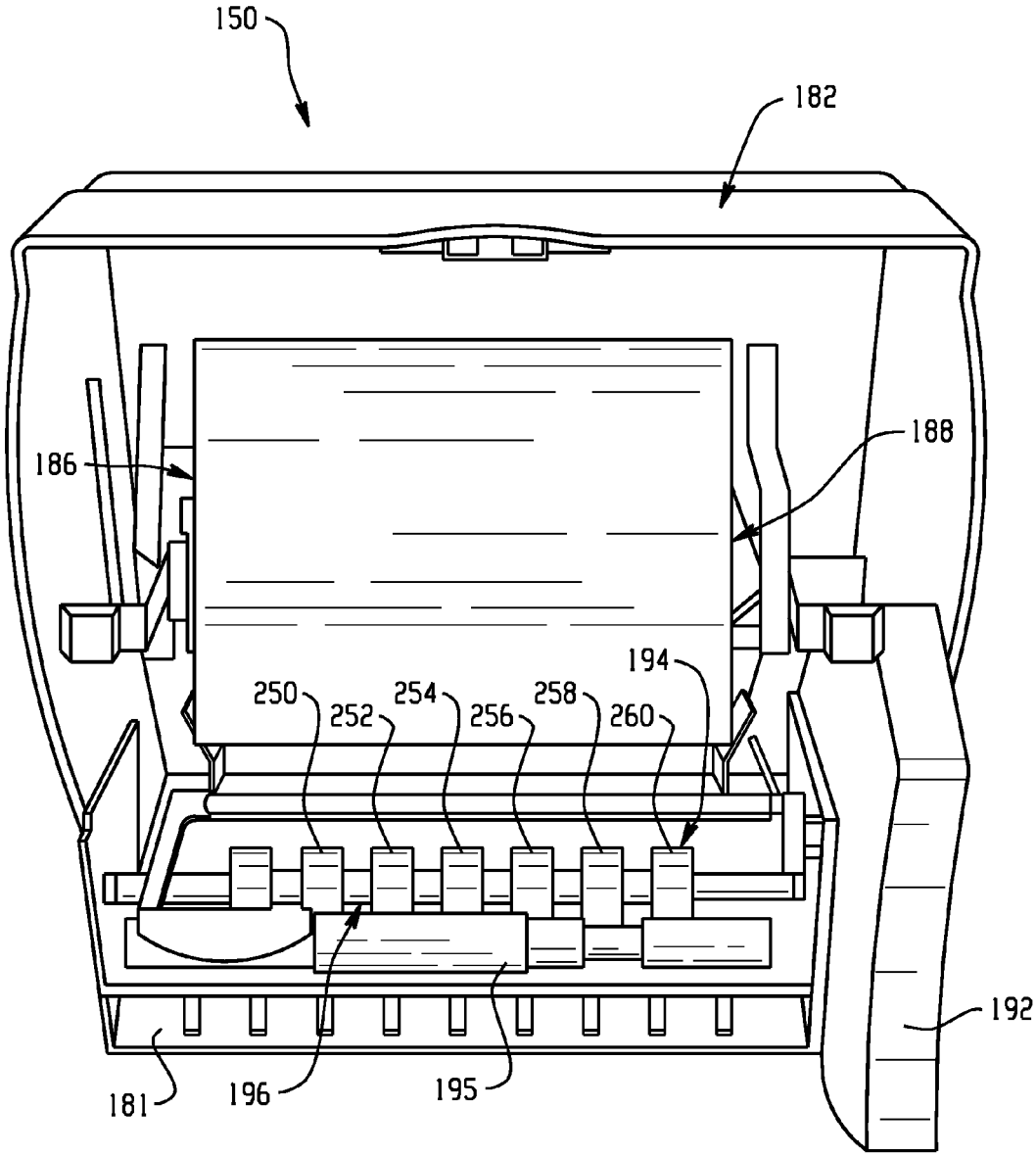
FIG. 11 is a schematic of a portion of the manual sheet product dispenser of FIG. 8.

Referring to FIGS. 9 and 11, the dispensing assembly 162 is provided to dispense a portion of the roll of sheet product 152. The dispensing assembly 162 includes hubs 186, 188, a drive member 190, a push bar 192, a feed roller 194, a drive shaft 196, a pinion 198, a one-way clutch bearing 200, and a spring 202.

The hubs 186, 188 are attached to the back housing portion 180 and are configured to hold the roll of sheet product 152 therebetween. When dispensing a portion of the roll of sheet product 152, the roll of sheet product 152 rotates relative to the hubs 186, 188.

Figure 10:
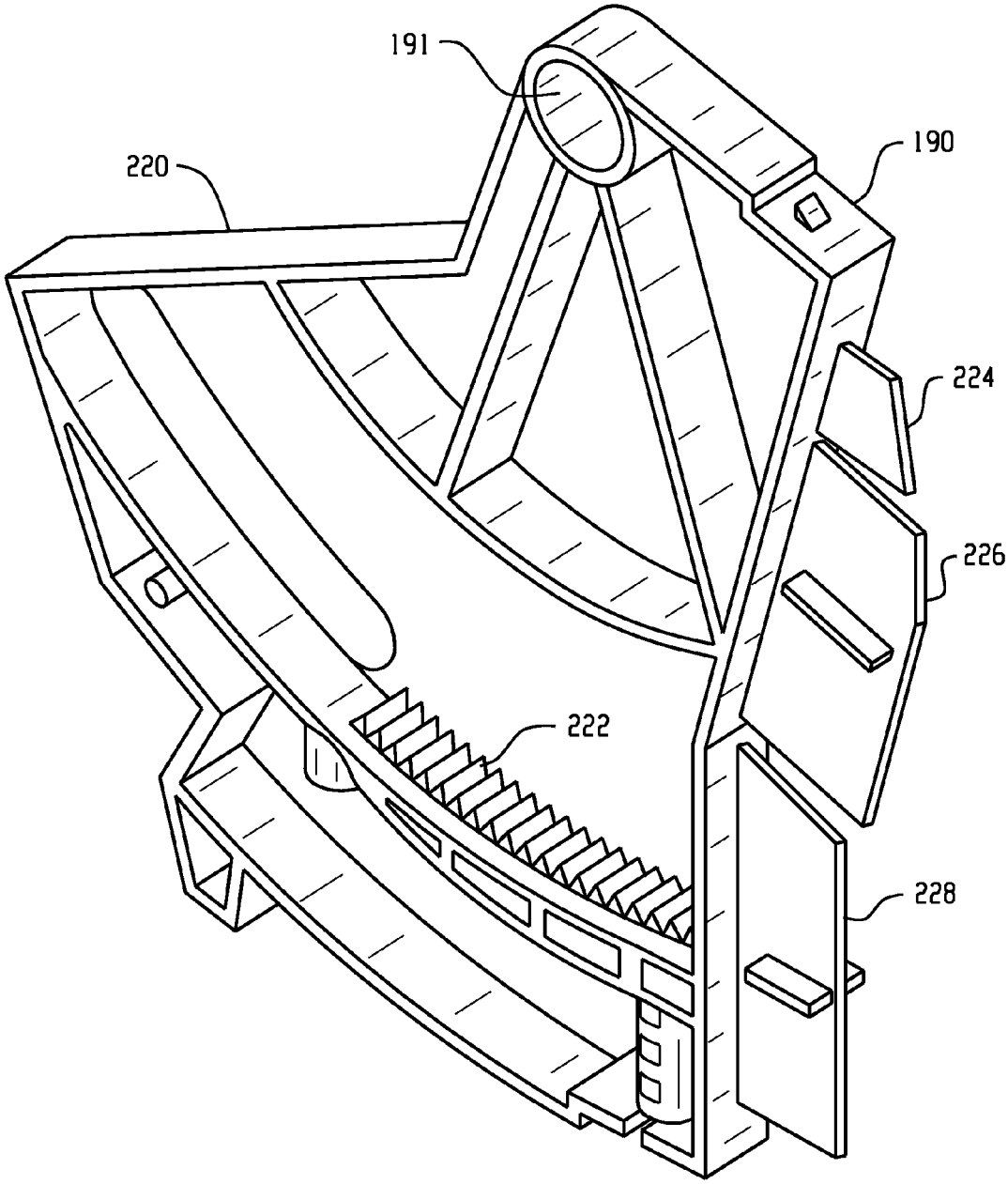
FIG. 10 is a schematic of a drive member utilized in the manual sheet product dispenser of FIG. 8.

Referring to FIGS. 9 through 11, the drive member 190 is provided to drive the feed roller 194. The drive member 190 includes a peripheral frame 220, a toothed-rack portion 222, tab members 224, 226, 228 and a magnet 230. The drive member 190 is rotatably coupled to the back housing portion 180 at a pivot point 191. The toothed-rack portion 222 extends across an interior region defined by the peripheral frame 220. The toothed-rack portion 222 is configured to engage teeth in the pinion 198 which rotates about the drive shaft 196. The drive shaft 196 is further mounted in the one-way clutch bearing 200 which has the pinion 198 secured thereabout. During operation, when the push bar 192 attached to the drive member 190 is pushed inwardly by a person, the drive member 190 induces the drive shaft 196 to rotate the feed roller 194 to urge a portion of the roll of sheet product 152 between the feed roller 194 and a pinch roller 195 to be dispensed. In one exemplary embodiment, the feed roller 194 includes roller portions 250, 252, 254, 256, 258 and 260 operably coupled to the drive shaft 196. The spring 202 is configured to bias the drive member 190 such that the push bar 192 extends outwardly from the front cover 182. The tab members 224, 226, 228 are configured to engage the push bar 192 for coupling to the push bar 192 to the drive member 190.

Referring to FIGS. 9 and 12, the position sensor 164 is configured to generate a signal when the magnet 230 is disposed proximate to the position sensor 164. The magnet 230 is coupled to the drive member 190. When the push bar 192 is pushed such that the drive member 190 is moved inwardly from a first operational position toward a second operational position, the position sensor 164 detects the magnet 230 and generates a signal which is received by the controller 170.

The ultraviolet light source 166 is configured to emit ultraviolet light in response to signal received from the controller 170, when the push bar 192 is pushed inwardly. In one exemplary embodiment, the ultraviolet light source 166 is disposed on an external portion of the housing 160 (FIG. 8). Further, in one exemplary embodiment, the ultraviolet light is in either the B-band (i.e., 320 nm-280 nm wavelength with energy per photon of 3.10-3.87 eV) or C-band (i.e., below 280 nm wavelength with energy per photon of 4.43-6.20 eV) of an ultraviolet light spectrum. In another exemplary embodiment, the ultraviolet light has a wavelength of 253.7 nm with a radiation level of 3.0 Joules/$m^2$.

The controller 170 is provided to control operation of the ultraviolet light source 166 in the manual sheet product dispenser 150. The controller 170 is electrically coupled to the position sensor 164 and the ultraviolet light source 166. The controller 170 is configured to receive a signal from the position sensor 164 indicating a person has depressed the push bar 192, such that a person's hands are disposed proximate to the housing 160 (FIG. 8). The controller 170 is further configured to generate another signal to induce the ultraviolet light source 166 to emit ultraviolet light onto the person's hands to kill bacteria thereon.

Figure 13:
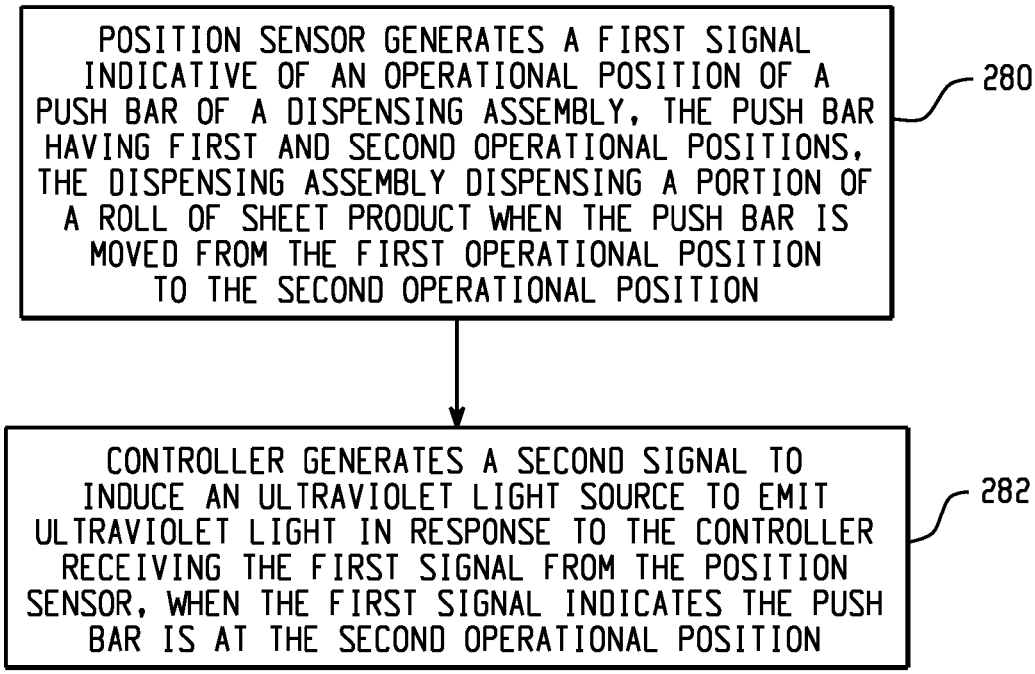
FIG. 13 is a flowchart of a method for controlling the manual sheet product dispenser of FIG. 8 in accordance with another exemplary embodiment.

Referring to FIG. 13 (with periodic reference to FIGS. 8, 9 and 12), a flowchart of a method for controlling the manual sheet product dispenser 150 in accordance with another exemplary embodiment will now be explained.

At block 280, the position sensor 164 generates a first signal indicative of an operational position of the push bar 192 of the dispensing assembly 162. The push bar 192 has first and second operational positions. The dispensing assembly 162 dispenses a portion of the roll of sheet product 152 when the push bar 192 is moved from the first operational position to the second operational position.

At block 282, the controller 170 generates a second signal to induce the ultraviolet light source 166 to emit ultraviolet light in response to the controller 170 receiving the first signal from the position sensor 164, when the first signal indicates the push bar 192 is at the second operational position.

The dispensers for dispensing a roll of sheet product and the methods associated therewith provide a substantial advantage over other dispensers and methods. In particular, the dispensers and methods provide a technical effect of emitting an ultraviolet light to kill bacteria on a person's hand.

While the invention has been described with reference to exemplary embodiments, it will be understood by those skilled in the art that various changes may be made and equivalent elements may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying this invention, but that the invention will include all embodiments falling within the scope of the appended claims. Moreover, the use of the terms, first, second, etc. are used to distinguish one element from another. Furthermore, the use of the terms a, an, etc. do not denote a limitation of quantity, but rather denote the presence of at least one of the referenced items.

What is claimed is:

1. A sheet product dispenser, comprising:

a housing;

a dispensing assembly disposed in the housing, the dispensing assembly configured to hold a roll of sheet product thereon and to dispense a portion of the roll of sheet product;

a proximity sensor configured to generate a first signal when an object is disposed proximate to and outside of the housing;

an ultraviolet light source disposed on the housing, the ultraviolet light source configured to emit ultraviolet light in response to a second signal;

a motor operably coupled to the dispensing assembly, the motor configured to actuate the dispensing assembly to dispense a portion of the roll of sheet product, in response to a third signal; and a controller operably coupled to the proximity sensor, the ultraviolet light source, and the motor, the controller configured to generate the second signal to induce the ultraviolet light source to emit ultraviolet light toward the object with sufficient energy to kill bacteria in response to receiving the first signal from the proximity sensor, the controller further configured to generate the third signal in response to receiving the first signal from the proximity sensor.

2. The sheet product dispenser of claim 1, wherein the ultraviolet light emitted from the ultraviolet light source is in a B-band of an ultraviolet light spectrum.

3. The sheet product dispenser of claim 1, wherein the ultraviolet light emitted from the ultraviolet light source is in a C-band of an ultraviolet light spectrum.

4. A sheet product dispenser, comprising:

a housing;

a dispensing assembly disposed in the housing, the dispensing assembly configured to hold a roll of sheet product thereon, the dispensing assembly having a push bar, a drive member coupled to the push bar and rotatably coupled at a pivot point to the housing, a feed roller operably coupled to the drive member, and a magnet coupled to the drive member, the drive member configured to induce the feed roller to dispense a portion of the roll of sheet product when the push bar is moved from a first operational position to a second operational position and the drive member is rotated about the pivot point;

a position sensor configured to generate a first signal in response to the position sensor detecting the magnet on the drive member when the push arm is at the second operational position; and a controller configured to generate a second signal to induce an ultraviolet light source disposed on the housing to emit ultraviolet light toward an object disposed proximate to and outside of the housing with sufficient energy to kill bacteria, in response to the controller receiving the first signal.

5. The sheet product dispenser of claim 4, wherein the ultraviolet light emitted from the ultraviolet light source is in a B-band of an ultraviolet light spectrum.

6. The sheet product dispenser of claim 4, wherein the ultraviolet light emitted from the ultraviolet light source is in a C-band of an ultraviolet light spectrum.

7. A method for controlling a sheet product dispenser, the sheet product dispenser having a housing, a proximity sensor, a dispensing assembly, an ultraviolet light source, and a controller, the method comprising:

generating a first signal when an object is disposed proximate to and outside of the housing of the sheet product dispenser utilizing the proximity sensor;

generating a second signal to induce the ultraviolet light source to emit ultraviolet light toward the object with sufficient energy to kill bacteria utilizing the controller in response to the controller receiving the first signal from the proximity sensor;

generating a third signal utilizing the controller in response to the controller receiving the first signal from the proximity sensor; and actuating the dispensing assembly utilizing a motor to dispense a portion of a roll of sheet product, in response to the motor receiving the third signal.

8. The method of claim 7, wherein the ultraviolet light emitted from the ultraviolet light source is in a B-band of an ultraviolet light spectrum.

9. The method of claim 7, wherein the ultraviolet light emitted from the ultraviolet light source is in a C-band of an ultraviolet light spectrum.

10. A method for controlling a sheet product dispenser, the sheet product dispenser being configured to hold a roll of sheet product thereon, the sheet product dispenser having a housing, a push bar, a drive member coupled to the push bar, and a feed roller operably coupled to the drive member, the method comprising:

moving the push bar from a first operational position to a second operational position such that the drive member rotates about a pivot point on the housing and induces the feed roller to dispense a portion of a roll of sheet product;

generating a first signal in response to the position sensor detecting a magnet on the drive member when the push arm is at the second operational position; and generating a second signal to induce an ultraviolet light source to emit ultraviolet light toward an object disposed proximate to and outside of the housing with sufficient energy to kill bacteria utilizing a controller in response to the controller receiving the first signal from the position sensor.

11. The method of claim 10, wherein the ultraviolet light emitted from the ultraviolet light source is in a B-band of an ultraviolet light spectrum.

12. The method of claim 10, wherein the ultraviolet light emitted from the ultraviolet light source is in a C-band of an ultraviolet light spectrum.

* * * * *